US005207159A

United States Patent [19]

DeMoore et al.

[11] Patent Number: 5,207,159

[45] Date of Patent: May 4, 1993

[54] COATING APPARATUS FOR SHEET-FED, OFFSET ROTARY PRINTING PRESSES

[75] Inventors: Howard W. DeMoore, 10954 Shady Trail, Dallas, Tex. 75220; Steven M. Person, Seagoville, Tex.

[73] Assignee: Howard W. DeMoore, Plano, Tex.

[21] Appl. No.: 879,841

[22] Filed: May 6, 1992

Related U.S. Application Data

[63] Continuation-in-part of Ser. No. 752,778, Aug. 30, 1991.

[51] Int. Cl.[5] ..... B41F 31/00

[52] U.S. Cl. ..... 101/350; 101/351; 101/367; 101/147; 118/261; 118/262

[58] Field of Search ..... 101/135, 147, 148, 157, 101/167, 169, 207, 208, 210, 329, 330, 331, 348, 349, 350, 351, 364, 365, 366, 367; 118/602, 612, 236, 242, 259, 261

[56] References Cited

U.S. PATENT DOCUMENTS

| | | | |
|---|---|---|---|
| 2,590,538 | 3/1952 | Hucu | 101/364 |
| 3,045,592 | 7/1962 | Shearer et al. | 101/364 |
| 3,540,409 | 11/1970 | Lloyd | 101/364 |
| 3,926,114 | 12/1975 | Matuschke | 101/148 |
| 4,066,014 | 1/1978 | Haaften | 101/366 |
| 4,270,483 | 6/1981 | Butler et al. | 118/262 |
| 4,287,846 | 9/1981 | Klein | 118/262 |
| 4,399,767 | 8/1983 | Simeth | 118/46 |
| 4,402,267 | 9/1983 | DeMoore | 101/419 |
| 4,653,303 | 3/1987 | Richard | 118/262 |
| 4,685,414 | 8/1987 | DiRico | 118/262 |
| 4,706,601 | 11/1987 | Jahn | 118/262 |
| 4,735,144 | 5/1988 | Jenkins | 101/364 |
| 4,779,557 | 10/1988 | Frazzitia | 118/262 |
| 4,796,556 | 1/1989 | Bird | 118/262 |
| 4,821,672 | 4/1989 | Bruno | 101/366 |
| 4,841,903 | 6/1989 | Bird | 118/46 |
| 4,895,070 | 1/1990 | Bird | 101/148 |
| 4,928,623 | 5/1990 | Kojima | 118/261 |
| 4,934,305 | 6/1990 | Woehler et al. | 101/329 |
| 4,939,992 | 7/1990 | Bird | 101/183 |
| 4,945,832 | 8/1990 | Odom | 101/364 |
| 4,998,474 | 3/1991 | Hauer | 118/261 |

FOREIGN PATENT DOCUMENTS

| | | | |
|---|---|---|---|
| 0071180 | 2/1983 | European Pat. Off. | 101/364 |

*Primary Examiner*—Eugene H. Eickholt
*Attorney, Agent, or Firm*—Dennis T. Griggs

[57] ABSTRACT

A coating apparatus for use in a sheet-fed or web-fed, offset rotary or flexographic printing press to apply a protective and/or decorative coating to the surface or freshly printed sheets includes a doctor blade coating unit coupled to a pickup roller for supplying liquid material from a reservoir to the surface of a pickup roller mounted on a press delivery drive shaft. Liquid material is circulated through the reservoir of the doctor blade unit by suction flow produced by a return pump. This prevents the buildup of a positive pressure differential within the doctor blade reservoir. The doctor blade reservoir is maintained at below ambient pressure level, thereby preventing leakage through the end seals. A vacuum sensor circuit provides a visual indication of air vacuum pressure in the doctor blade reservoir chamber, and a vacuum sensor switch applies electrical power to an audio transducer. The audio transducer produces an audible alarm in response to an increase in doctor blade chamber pressure, thereby providing advance warning of an impending end seal failure or a worn doctor blade condition.

21 Claims, 9 Drawing Sheets

COATING APPARATUS FOR SHEET-FED, OFFSET ROTARY PRINTING PRESSES

CROSS REFERENCE TO RELATED APPLICATION

This application is a continuation-in-part of application Ser. No. 07/752,778 filed Aug. 30, 1991.

FIELD OF THE INVENTION

This invention relates to sheet-fed or web-fed, offset rotary or flexographic printing presses, and more particularly, to a new and improved apparatus for the in-line application of protective and decorative coatings or inks to the printed surface of freshly printed sheets or web.

BACKGROUND OF THE INVENTION

Conventional sheet-fed, offset rotary printing presses typically include one or more printing stations through which individual sheets are fed and printed with wet ink. After final printing, the sheets are fed by a delivery conveyor system to the delivery end of the press where the freshly printed sheets are collected and stacked. In a typical sheet-fed, offset rotary printing press such as the Heidelberg Speedmaster line of presses, the delivery conveyor system includes a pair of endless gripper chains carrying spaced laterally disposed gripper bars and grippers which are used to grip and pull freshly printed sheets from the impression cylinder and convey the sheets toward the sheet delivery stacker. The gripper chains are driven in precisely timed relation to the impression cylinder by gripper chain sprocket wheels which are laterally spaced between a delivery drive shaft mounted on opposite sides of the press frame. The delivery drive shaft is mechanically coupled by gears for synchronous rotation with the impression cylinder.

Since the inks used with offset type printing presses typically remain wet and tacky for some time after printing, special precautions must be taken to insure that the wet inked surface of the freshly printed sheets is not marked or smeared as the sheets are transferred from one printing station to another, and through the delivery system to the sheet delivery stacker. The printed surface of the paper dries relatively slowly and can be smeared during subsequent processing, particularly when the printed sheets are stacked. In order to minimize smearing, a dryer may be mounted along the delivery path of the printed sheets, or an anti-offset spray powder may be sprayed on the printed surface.

In some printing applications, it is desirable that the press be capable of applying a protective and/or decorative coating over all or a portion of the surface of the printed sheets. Typical coating solutions include varnish, lacquer, dye, moisturizers and ink. Such coatings typically are formed of a UV-curable or water-soluble resin applied as a liquid solution or emulsion by an applicator roller over the freshly printed sheets to protect the ink and improve the appearance of the sheets. Use of such coatings is particularly desirable when decorative or protective finishes are required such as in the production of posters, record jackets, brochures, magazines, folding cartons and the like. In cases where a liquid coating is to be applied, the coating operation is carried out after the final ink printing has been performed, most desirably by an in-line coating application.

DESCRIPTION OF THE PRIOR ART

Various suggestions have been made for applying the coating as an in-line press operation by using the final printing station of the press as the coating application station. For example, in U.S. Pat. Nos. 4,270,483, 4,685,414 and 4,779,557, there are disclosed coating apparatus which can be moved into position to allow the blanket cylinder of the last printing station of a press to be used to apply a coating material to the sheets. In U.S. Pat. No. 4,796,556, there is disclosed a coating apparatus which can be selectively moved between the blanket cylinder or the plate cylinder of the last printing station of the press so that the station can be used as a coating station for the press.

Suggestions for overcoming the problem of the loss of a printing station when coating is desired have also been made, such as that set forth in U.S. Pat Nos. 4,934,305 which discloses a coating apparatus having a separate timed applicator roller positioned to apply the coating material to the printed sheet while the sheet is on the last impression cylinder of the press. This is said to allow the last printing station to be operated simultaneously as both an ink application station and a coating station so that no loss of press printing unit capability results. Another approach to providing a coating station without losing the printing capabilities of the last printing station is to provide a totally separate coating unit downstream of the last printing station so that the coating is applied to the sheets after final printing and before the sheets have reached the sheet delivery stacker. Such an approach is suggested in U.S. Pat. Nos. 4,399,767 and 4,706,601.

Conventional coating apparatus which is operable as an in-line press operation utilizes an engraved transfer roller, with the liquid coating being applied to the engraved roller by means of a doctor blade assembly. The doctor blade assembly includes an elongated housing having a reservoir chamber extending the length of the transfer roller for holding a volume of coating liquid in wetting contact with the circumferential surface of the transfer roller. A pair of circumferentially spaced doctor blades extend longitudinally along the reservoir housing on either side of the chamber. The doctor blades are angled tangentially toward the transfer roller surface, and seal the reservoir chamber against the roller surface and wipe the roller surface to deposit liquid in the cells of the engraved transfer surface.

The reservoir chamber is pressurized with coating liquid, which is pumped from a remote supply drum into the upper region of the pressure chamber. After the pressure chamber fills to a certain level, it is returned to the remote drum by gravity flow. Occasionally, the doctor blade reservoir chamber becomes completely filled with the coating liquid when the volume of coating liquid being delivered to the doctor blade reservoir chamber exceeds the gravity flow return rate. The positive pressure may cause the seals at the ends of the roller to leak, allowing the coating liquid to drip onto the floor or onto adjacent press parts. Occasionally, the coating liquid may be slung from the roller onto adjacent press equipment and operator areas. Moreover, the buildup of positive pressure within the doctor blade reservoir chamber accelerates the wear of the end seals.

It will be appreciated that the transfer roller may be operated at high speeds, for example, on the order of 1,000 linear feet per minute, and that the end seals of the doctor blade assembly will tend to wear quickly. The end seal wear is accelerated by the buildup of positive pressure within the doctor blade chamber. Low volume drip leakage can be collected in a drip pan or catch tray, but as the end seals wear, the coating liquid will be slung from the transfer roller, thereby causing a difficult cleanup problem. When this occurs, the press must be shut down, the doctor blade head must be removed, and the end seals replaced. The steps of rebuilding or replacing the end seals and realigning the doctor blade head causes an unacceptable amount of press downtime.

One approach for overcoming the problem of end seal wear is to provide stationary end seals which are mounted on the press frame, and which bear in sealing engagement against the ends of the transfer roller, so that the doctor blade head may form a seal with stationary seals rather than with the dynamic seals carried on the transfer roller. Another approach is to use rotary end seals which include an end plate which is resiliently engaged against the end surface of the transfer roller, with a seal member being secured between the end plate and the end portions of the roller by quick removal mounting lugs.

While the foregoing mechanical approaches to limiting end seal wear and thereby avoiding leakage have been moderately successful, and some arrangements have reduced downtime by quick change mounting features, the end seals nevertheless are still experiencing accelerated wear and early failure, thereby causing frequent replacements and unacceptable downtime for correction of end seal leakage.

OBJECTS OF THE INVENTION

Accordingly, there exists a need for a new and improved in-line coating apparatus for use in a sheet-fed or web-fed, offset rotary or flexographic printing press for applying a protective and/or decorative coating to the printed surface of freshly printed sheets which does not require any expensive or substantial press modification or result in any impairment of normal press operating capability.

Specifically, the principal object of the present invention is to provide a new and improved in-line coating and/or inking apparatus of the character described which achieves a reduction in end seal leakage.

SUMMARY OF THE INVENTION

The present invention provides a new and improved inline doctor blade apparatus for applying a protective and/or decorative coating and/or inking to the surface of freshly printed sheets in a sheet-fed or web-fed, offset rotary or flexographic printing press which is highly reliable and effective in use, yet which does not require any expensive or substantial press modification or result in any impairment of normal press operating capability.

The reservoir of a doctor blade head is supplied with coating material from a remote supply drum. To insure that an adequate supply of coating liquid is always present within the doctor blade reservoir, the coating material is drawn from the remote supply drum and is circulated by suction flow constantly through the reservoir. In contrast to the conventional approach of positively pressurizing the doctor blade reservoir with liquid coating pumped from the remote drum to the reservoir, the coating material is instead circulated through the reservoir by suction flow. That is, instead of charging the reservoir with coating liquid pumped from the remote drum and thereby creating a positive pressure condition within the doctor blade reservoir, circulation through the reservoir is induced by suction flow provided by a suction pump having an input connected for drawing coating liquid from the doctor blade reservoir, and returning it by forced (positive pressure) flow to the remote supply drum, rather than by gravity flow return.

As a result of the suction flow arrangement, the liquid material is drawn from the remote supply drum at a greater rate than the rate of withdrawal of the liquid material by the pickup roller, and a substantially constant supply of liquid material will always be present within the doctor blade reservoir. A benefit of the suction flow arrangement is that a positive pressure buildup does not occur within the doctor blade chamber. Moreover, liquid material which rises above a predetermined fill level is drawn out of the doctor blade reservoir by the suction pump, and is returned to the remote drum. Consequently, the end seals are not subjected to high pressure differential conditions. Instead, the suction flow arrangement produces a negative pressure differential, with the doctor blade chamber being operated at a level below atmospheric. Under negative pressure conditions, leakage of coating liquid is virtually nonexistent, and the operating life of the end seals is substantially increased.

According to another aspect of the present invention, visual and audible alerts are provided by a vacuum sensor line which is coupled to the vacuum space within the doctor blade chamber. The sensor line is coupled to a vacuum gauge which provides a visual indication of the suction pressure within the doctor blade chamber. A vacuum sensor switch is also coupled to the chamber for selectively applying electrical power to an audio transducer when the pressure within the vacuum chamber rises above a predetermined safe operating suction level.

Other features and advantages of the present invention will become more apparent from the following detailed description taken in conjunction with the accompanying drawings which disclose, by way of example, the principles of the invention.

DETAILED DESCRIPTION OF THE PREFERRED EMBODIMENT

Figure 1:
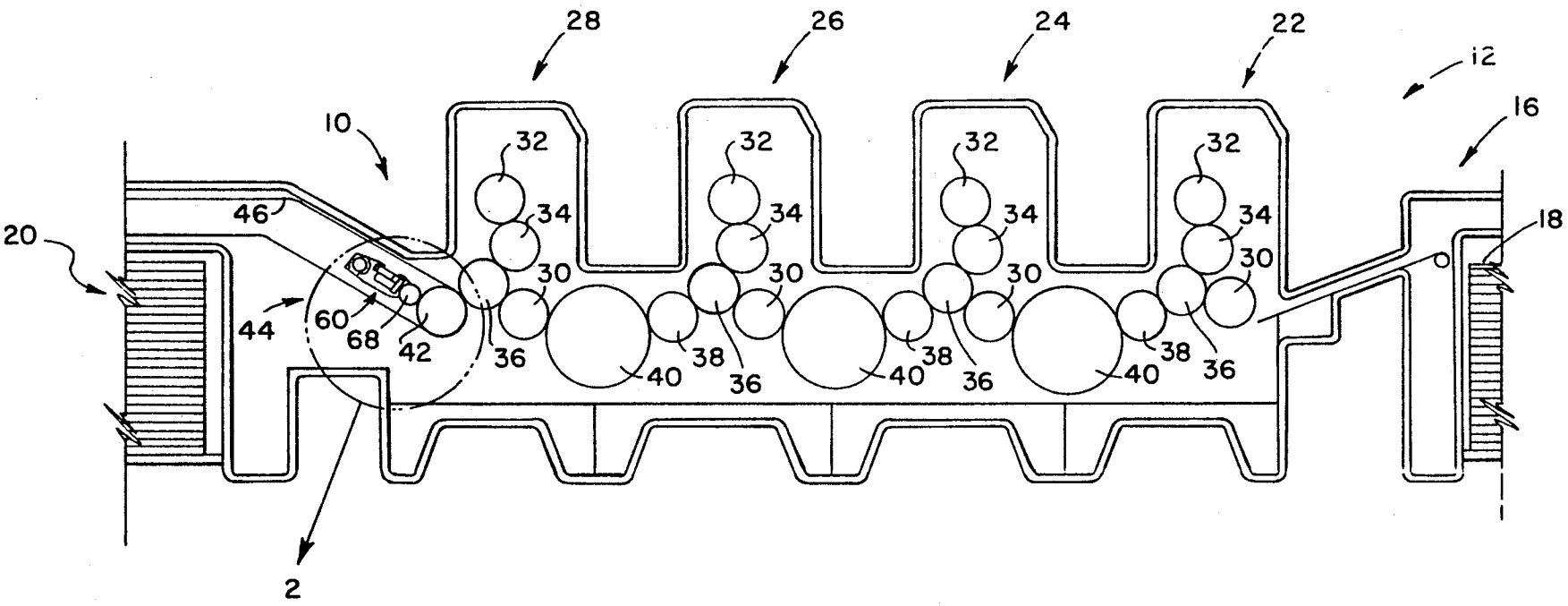
FIG. 1 is a schematic side elevational view of a sheet-fed, offset rotary printing press having a coating apparatus embodying the present invention.

As shown in the exemplary drawings, the present invention is embodied in a new and improved in-line doctor blade apparatus, herein generally designated 10, for use in applying a protective and/or decorative coating or inks to the freshly printed surface of sheets printed in a sheet-fed or web-fed, offset rotary or flexographic printing press, herein generally designated 12. In this instance, as shown in FIG. 1, the doctor blade coating apparatus 10 is illustrated as installed in a four color printing press 12, such as that manufactured by Heidelberger Druckmaschinen AG of the Federal Republic of Germany under its designation Heidelberg Speedmaster 102V (40"), and which includes a press frame 14 coupled at one end, herein the right end, with a sheet feeder 16 from which sheets, herein designated 18, are individually and sequentially fed into the press, and at the opposite end, with a sheet delivery stacker 20 in which the finally printed sheets are collected and stacked. Interposed between the sheet feeder 16 and the sheet delivery stacker 20 are four substantially identical sheet printing stations 22, 24, 26 and 28 which can print different color inks onto the sheets as they are moved through the press 10.

As illustrated, each of the printing stations 22, 24, 26 and 28 is substantially identical and of conventional design, herein including a sheet-fed cylinder 30, a plate cylinder 32, a blanker cylinder 34 and an impression cylinder 36, with each of the first three printing stations 22, 24 and 26 having a transfer cylinder 38 disposed to withdraw the freshly printed sheets from the adjacent impression cylinder and transfer the freshly printed sheets to the next printing station via a transfer drum 40. The final printing station 28 herein is shown as equipped with a delivery cylinder 42 which functions to support the printed sheet 18 as it is moved from the final impression cylinder 36 by a delivery conveyor system, generally designated 44, to the sheet delivery stacker 20.

Figure 2:
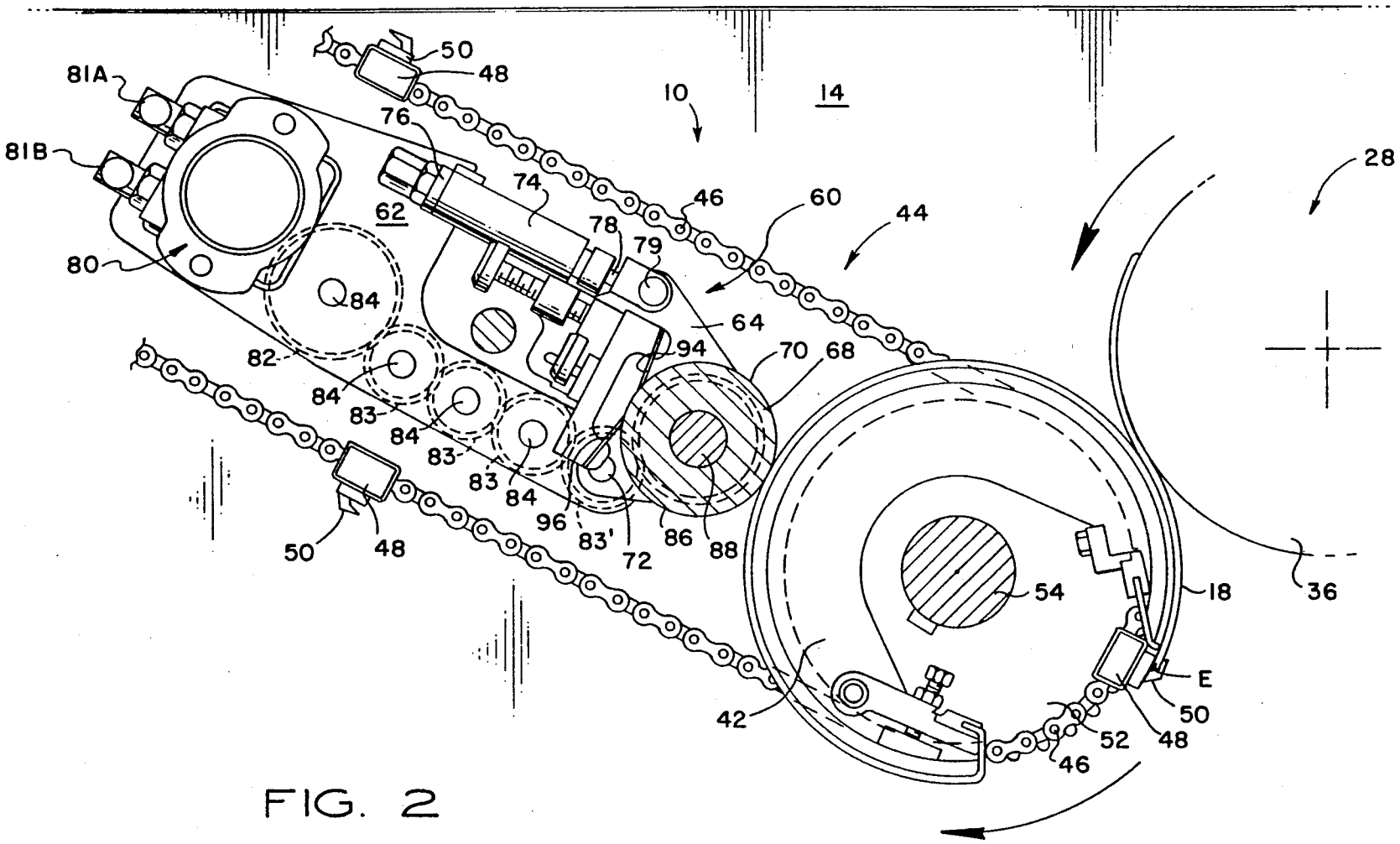
FIG. 2 is an enlarged fragmentary side elevational view taken substantially within the circular area designated "2" in FIG. 1 and showing the coating apparatus of the present invention during coating operation.

The delivery conveyor system 44 as shown in FIG. 2 is of conventional design and includes a pair of endless delivery gripper chains 46, only one of which is shown carrying at regular spaced locations along the chains, laterally disposed gripper bars 48 having gripper elements 50 used to grip the leading edge of a sheet 18 after it leaves the nip between the delivery cylinder 42 and impression cylinder 36 of the last printing station 28. As the leading edge E of the sheet 18 is gripped by the grippers 50 the delivery chains 46 pull the sheet away from the impression cylinder 36 and convey the freshly printed sheet to the sheet delivery stacker 20 where the grippers release the finally printed sheet.

The endless delivery chains 46 are driven in synchronous timed relation to the impression cylinder 36 by sprocket wheels 52 fixed adjacent the lateral ends of a delivery drive shaft 54 which has a mechanically geared coupling (not shown) to the press drive system. The delivery drive shaft 54 extends laterally between the sides of the press frame 14 adjacent the impression cylinder 36 of the last printing station 28, and is disposed to be parallel with the axis of the impression cylinder. In this instance, the delivery cylinder 42, which is constructed to allow adjustments in diameter by suitable means, is attached to the delivery drive shaft 54 so that the delivery cylinder is also rotated in precise timed relation with the impression cylinder.

In this respect, it is important to note that when the freshly printed sheets 18 are conveyed away from the impression cylinder 36 of the final printing station 28 by the gripper 50 carried by the delivery chains 46, the wet inked surfaces of the sheets face the delivery drive shaft 54 and the sheets must be supported such that the ink is not smeared as the sheets are transferred. Typically, such support is provided by skeleton wheels or cylinders mounted to the press delivery drive shaft 54, or as is now more commonly used, net equipped delivery cylinders marketed by Printing Research, Inc. of Dallas, Tex. under its registered trademark SUPERBLUE. That system, which is made and sold under license, is manufactured in accordance with and operates as described in U.S. Pat. No. 4,402,267, issued Sep. 6, 1983, to Howard W. DeMoore, the disclosure of which is incorporated herein by this reference.

More recently, vacuum transfer apparatus of the type disclosed in co-pending U.S. application Ser. No. 07/630,308, filed Dec. 18, 1990, entitled "Vacuum Transfer Apparatus for Sheet-Fed Printing Presses", which is also incorporated herein by reference, has been used. The vacuum transfer apparatus disclosed in that application can be used in place of delivery cylinders or skeleton wheels to pull the unprinted side of the sheet away from the delivery drive shaft 54 so that the wet ink surface of the sheets do not come into contact with any press apparatus.

In accordance with the present invention, the in-line doctor blade coating apparatus 10 for applying the protective or decorative coating or ink to the sheets 18 enables the press 12 to be operated in the normal manner without the loss of the final printing station 28, and without requiring any substantial press modifications by employing the existing press delivery drive shaft 54 as the mounting location for the coating applicator roller. In presses having delivery systems such as skeleton wheels mounted on the delivery drive shaft 54 or a vacuum transfer apparatus as disclosed in the aforementioned co-pending U.S. application Ser. No. 07/630,308, conversion to a coating operation can be quickly and easily achieved by mounting on the press delivery drive shaft in place of the skeleton wheels or in addition to the vacuum transfer apparatus, a suitable support cylinder capable of performing the combined function of a coating applicator roller and a net enhanced delivery cylinder 42. By utilizing the delivery cylinder 42 mounted on the delivery drive shaft 54 to also act as a coating applicator roller, protective coating will be applied to the printed sheet 18 in precise timed registration, and will permit the press to be operated with its full range of printing stations.

Toward these ends, the coating apparatus 10 of the present invention includes a relatively simple, positive acting and economical doctor blade coating unit, generally designated 60, mounted to the press frame 14 downstream of the delivery drive shaft 54 and positioned to apply liquid coating material to the support surface of a delivery cylinder 42 mounted on the delivery drive shaft. As can best be seen in FIGS. 2, 3 and 4, the doctor blade coating unit 60 herein comprises a pair of side frames 62, only one of which is shown, it being understood that the other side frame is substantially the same as that of the side frame illustrated, attached to each side of the press frame 14. Pivotally mounted to one end of each of the side frames 62 is a support bracket 64 carrying one end of a liquid material reservoir 66 and cooperating liquid material pickup roller 68 each disposed to extend laterally across the press 12 parallel with the delivery drive shaft 54. The coating unit 60 is mounted between the upper and lower runs of the delivery chains 46 downstream of the delivery drive shaft 54, and positioned so that the outer peripheral surface 70 of the pickup roller 68 can be engaged with the support surface of a delivery cylinder 42 mounted on the delivery drive shaft.

Figure 3:
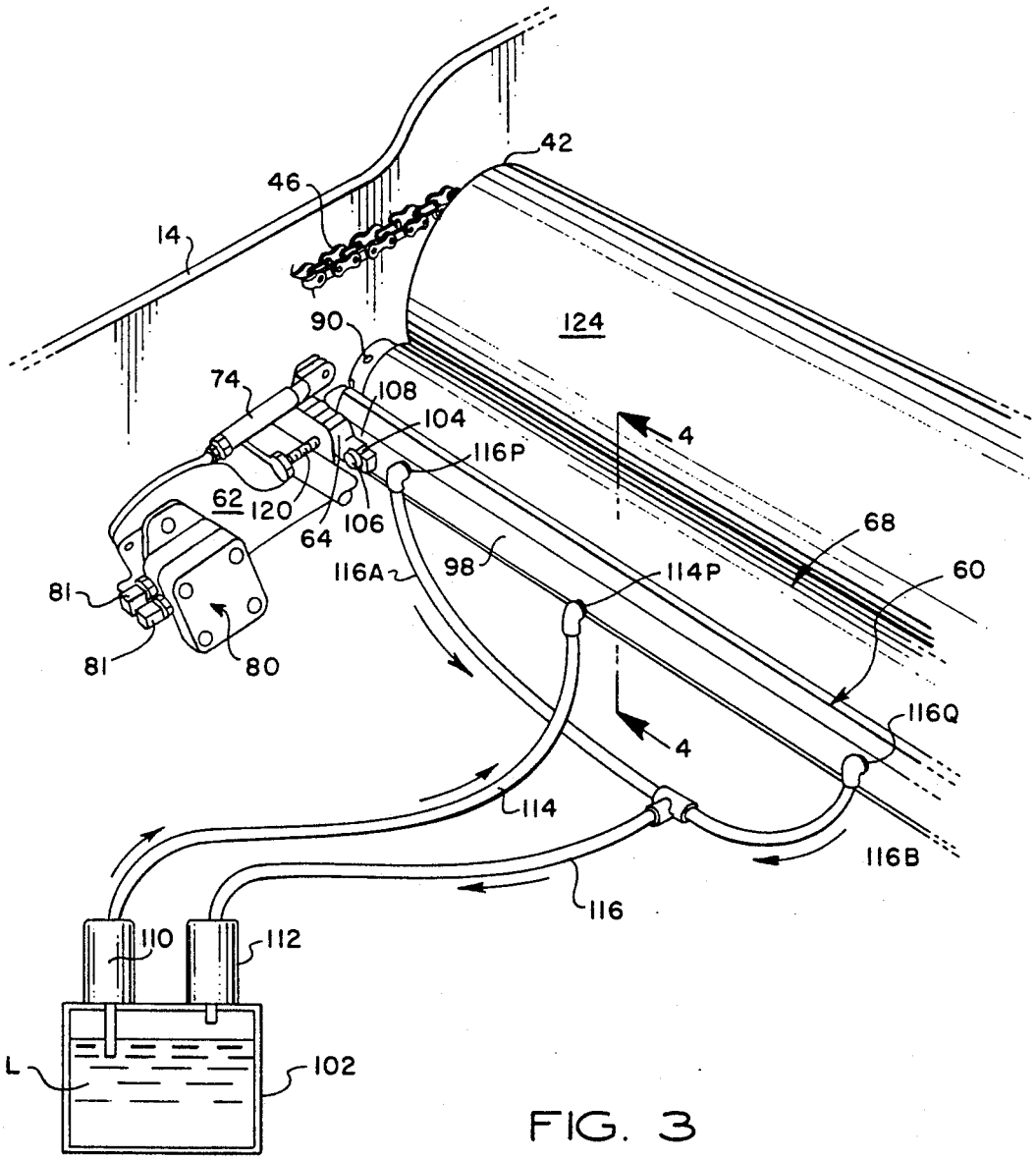
FIG. 3 is an enlarged fragmentary perspective view showing one side of the coating apparatus mounted in the press and illustrating the fluid path of coating material from a remote supply drum to the doctor blade reservoir of the coating unit.

As best seen in FIGS. 2 and 3, the support bracket 64 is pivotally attached to the end of the side frame 62 by a shaft 72 disposed at the lower end portion of the bracket, and can be pivoted about the shaft by an extensible cylinder 74, herein shown as a pneumatic cylinder, one end 76 of which is secured such as by welding to the side frame, and the opposite end 78 of which is coupled through a pivot shaft 79 to the upper end portion of the bracket. By extending or retracting the cylinder 74, the extent of engagement of the pickup roller 68 against the surface of the applicator roller 42 can be controlled, and the pickup roller can be completely disengaged from the applicator roller 42.

The coating pickup roller 68, which is of conventional design and preferably one such as the Anilox rollers manufactured by A.R.C. International of Charlotte, N.C. and sold under the name "PRINTMASTER" having an engraved ceramic or chrome outer peripheral surface 70, is designed to pick up a predetermined uniform thickness of liquid coating material or ink from the reservoir 66, and then uniformly transfer the coating material to the support surface of the applicator roller 42. To effect rotation of the pickup roller 68, a suitable motor 80, herein a hydraulic motor, is attached to one of the side frames 62 and coupled to a suitable hydraulic fluid source (not shown) through fittings 81A, 81B. Attached to the output of the motor 80 is an output gear which is drivingly coupled through a cluster gear 82 and a series of idler gears 83 each mounted on stub axles 84, to a drive gear 86 attached to the end of a shaft 88 on which the pickup roller 68 is concentrically mounted. The shaft 88 of the pickup roller 68 is, in turn, journaled at each end to the brackets 64 through a releasable semicircular collar 90 attached by bolts 92 to the bracket. Herein, the axle of the terminal idler gear, designated 83', also serves as the shaft 72 for pivotally mounting the support bracket 64 to the side frame 62 so that when the bracket is rotated about the shaft, the terminal idler gear remains engaged with the drive gear 86 of the pickup roller 68.

Figure 4:
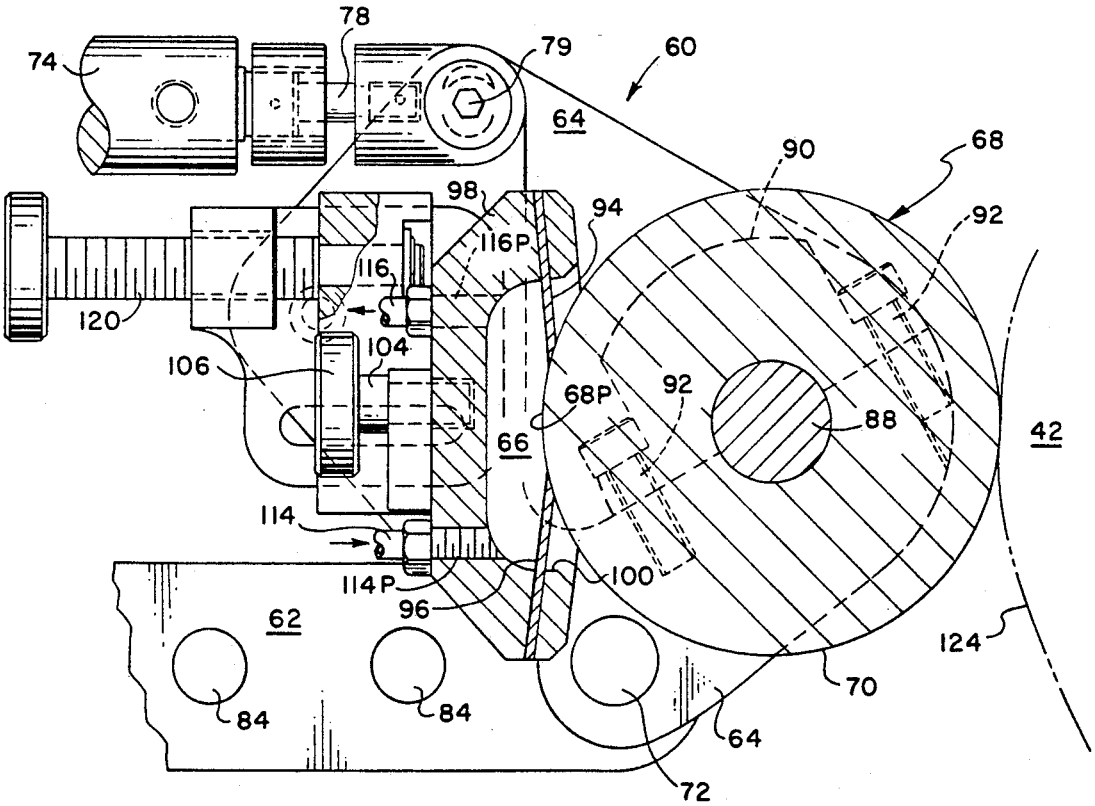
FIG. 4 is an enlarged fragmentary sectional view taken substantially along the line 4—4 of FIG. 3.

In this instance, as can best be seen in FIG. 4, the pickup roller 68 has a peripheral surface portion 68P which projects radially into the reservoir 66 containing the supply of coating material or ink. A pair of upper and lower inclined doctor blades 94 and 96 attached to the doctor blade head 98 on shoulders 98A, 98B engage the roller surface to doctor the excess liquid coating material or ink picked up from the reservoir by the engraved surface 70 of the roller. The reservoir cavity 66 herein is formed within an elongated doctor blade head 98 having a generally C-shaped cross-section with an opening 100 extending longitudinally along one side facing the pickup roller 68. The reservoir 66 is supplied with liquid material or ink from a supply drum 102 disposed in a remote location within or near the press 12. preferably, the doctor blade head 98 is removably attached to the brackets 64, herein by bolts 104 having enlarged, knurled heads 106, and which can be threaded through slots 108 formed in the brackets to clamp the reservoir in place on the brackets.

Figure 5:
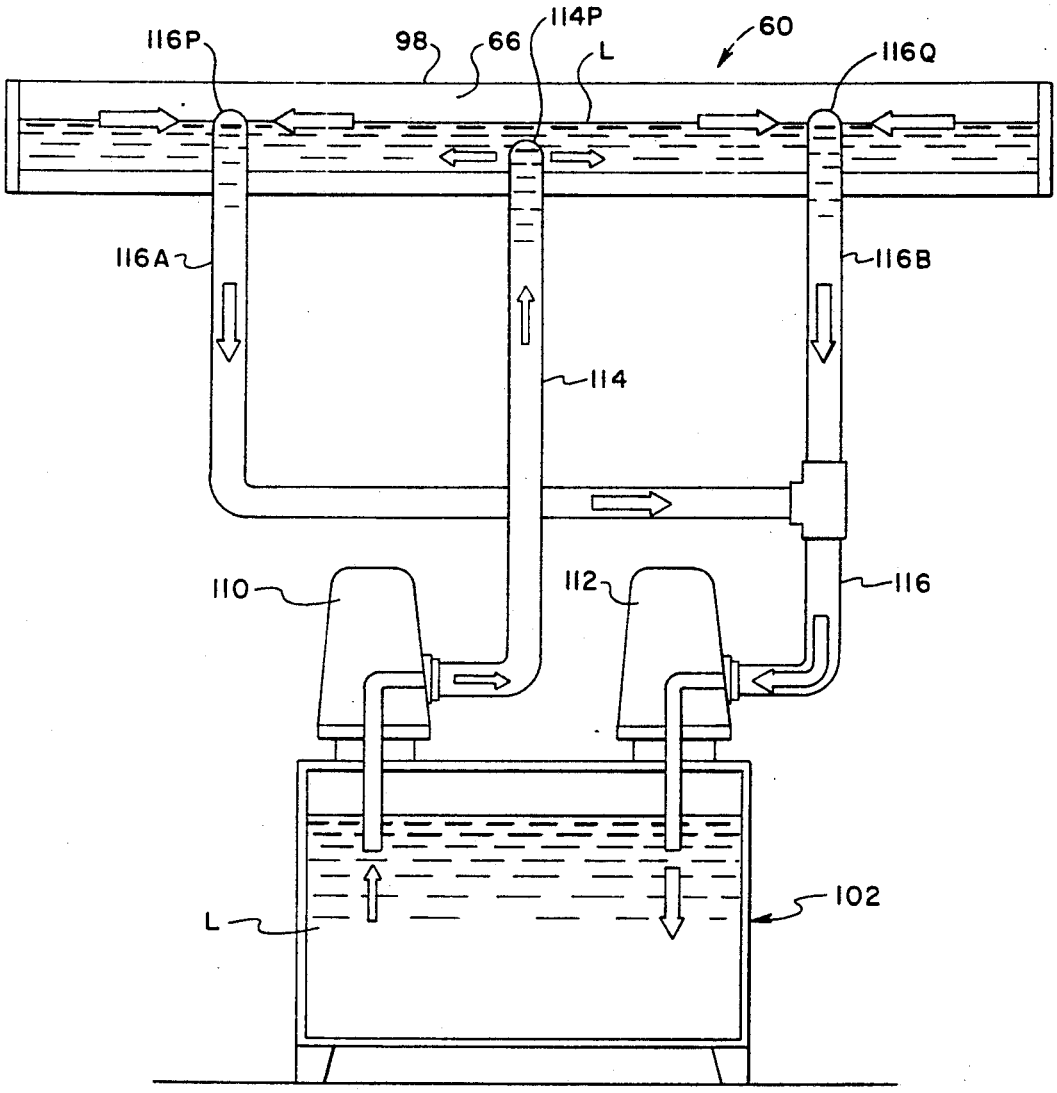
FIG. 5 is a simplified flow diagram which illustrates a dual pump arrangement for circulating coating liquid from a remote supply drum to the doctor blade reservoir and return.

To insure that an adequate supply of liquid coating material is always present within the reservoir 66 and to prevent coagulation and clogging of the doctor blades 94 and 96 by the liquid coating material or ink, the coating material or ink is circulated through the reservoir by two pumps 110 and 112 as shown in FIG. 5. Pump 110 draws the liquid material L from the supply drum 102 via a supply line 114 and discharges it into a bottom region of the reservoir 66 through a delivery port 114P, and the other pump 112 acts to provide suction to a pair of return lines 116A, 116B coupled adjacent a top region of the reservoir through return ports 116P, 116Q for withdrawing excess liquid coating material or ink from the reservoir. By supplying the coating material or ink from the supply drum 102 at a greater rate than the rate of withdrawal of material by the pickup roller 68, a substantially constant supply of coating material or ink will always be present within the reservoir 66. The excess coating material or ink which rises above the liquid level of the return port R (FIG. 8) is suctioned away by the suction return pump 112.

The general arrangement of the pickup roller 68, doctor blades 94 and 96, and reservoir 66 is similar to that disclosed in U.S. Pat. No. 4,821,672 entitled "Doctor Blade Assembly With Rotary End Seals and Interchangeable Heads", the disclosure of which provides details concerning the end seal structure and operation of a pickup roller and reservoir usable with the present invention. According to an important feature of the present invention, however, the doctor blade reservoir 66 is not pressurized as taught by the prior art. Instead, coating liquid or ink is supplied to the doctor blade reservoir 66 by the suction flow produced by the pump 112. In this arrangement, the suction pump 112 applies a vacuum or suction force in the reservoir which draws liquid material L from the supply through the supply conduit 114 to the reservoir and draws excess liquid material L from the doctor blade reservoir 66 through the return conduit 116 into the remote reservoir 102 at a rate which is greater than the rate that liquid coating material or ink is being supplied to the doctor blade reservoir through the supply conduit 114. Because the suction return flow rate is greater than the supply flow rate, a positive pressure condition within the doctor blade reservoir is avoided, and a below atmospheric vacuum pressure level is provided.

Referring to FIG. 5, FIG. 6, FIG. 7 and FIG. 8, the liquid material is delivered into the lower region of the doctor blade reservoir 66, and is withdrawn from the doctor blade reservoir near an upper region of the chamber through the return conduits 116A, 16B. The liquid level elevation of the return port is preferably selected to provide for the accumulation of liquid coating material or ink in more than about half of the doctor blade chamber, thereby insuring that the engraved surface of the pickup roller 68 will be thoroughly wetted by the coating material or ink L as it turns through the doctor blade chamber 66. The reservoir 66 is bounded vertically by lower and upper doctor head shoulders 98A, 98B. Accordingly, the return ports 116P, 116Q of return lines 116A, 116B are located at a liquid level R intermediate the limits established by the lower and upper shoulders. Any excess liquid coating material or ink which rises above the liquid level R of the return ports will be suctioned away by the pump 112.

Figure 6:
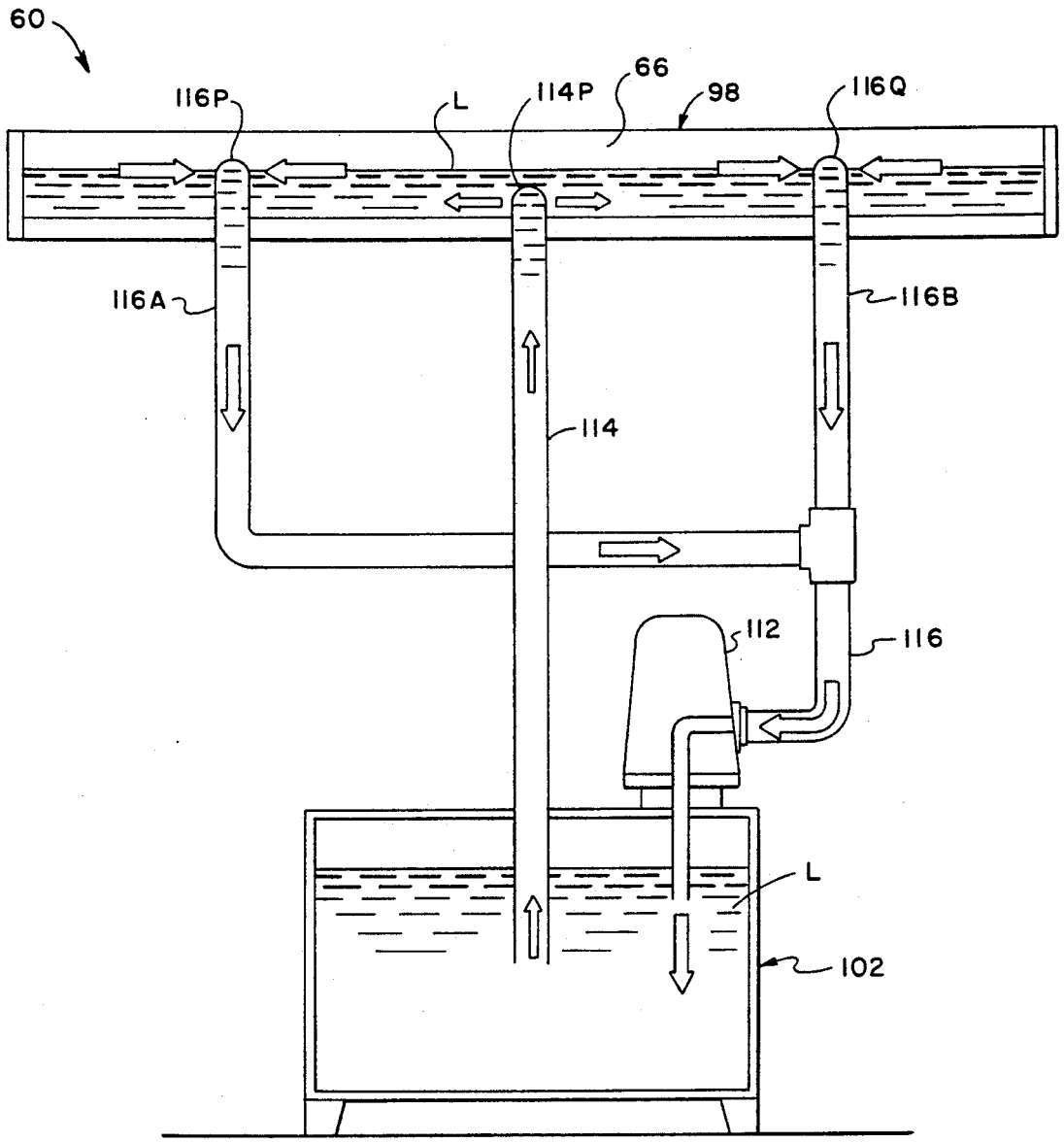
FIG. 6 is a simplified flow diagram which illustrates a single pump arrangement for circulating coating liquid by suction flow from a remote supply drum to the doctor blade reservoir and return.
Figure 7:
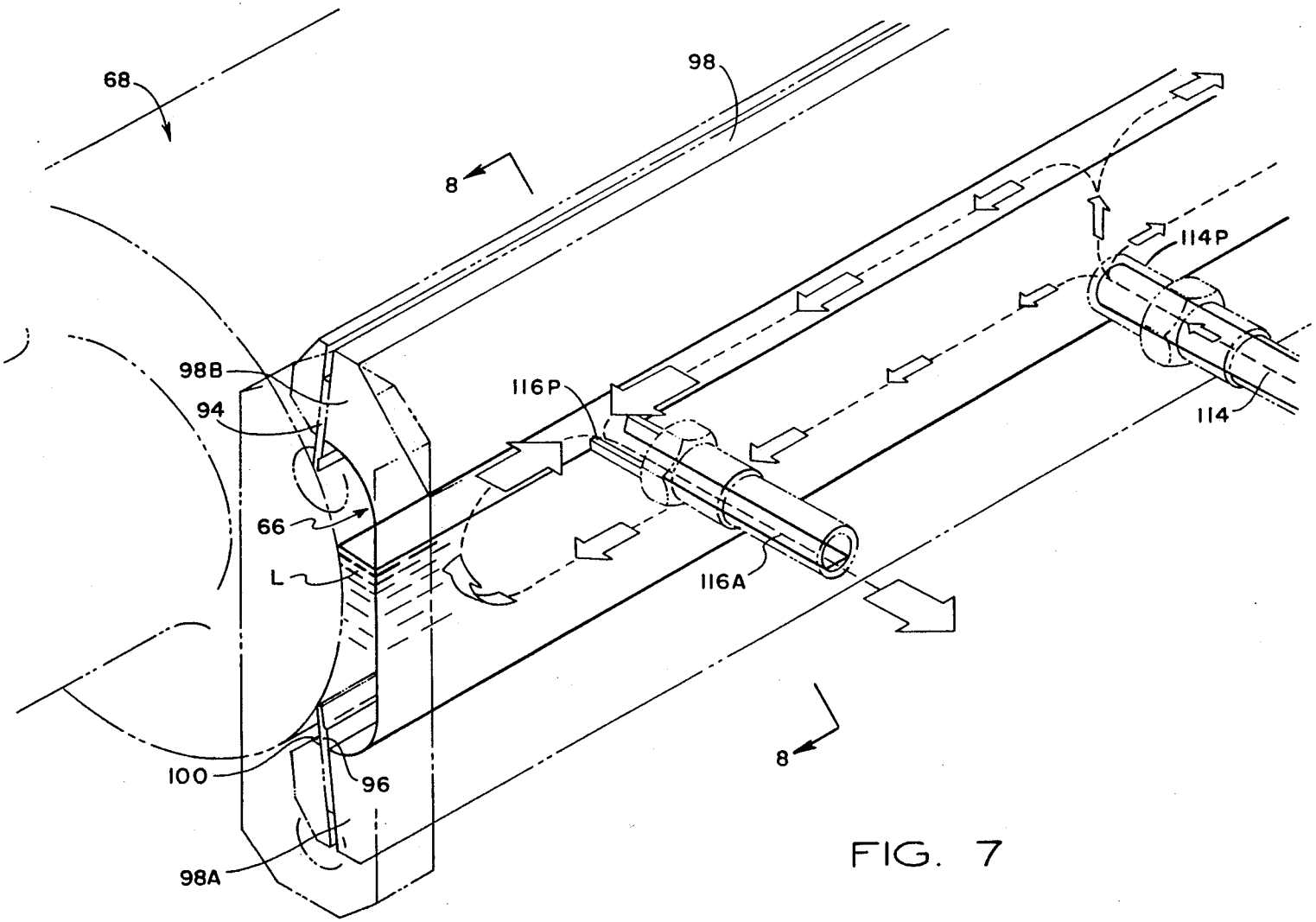
FIG. 7 is an enlarged fragmentary perspective view of one end portion of the doctor blade coating apparatus of the present invention.

It will be appreciated that the supply pump 110 is optional, and that the suction circulation system can be operated effectively with only the single suction pump 112 as shown in FIG. 6. In the single pump configuration, it may be necessary to prime the supply conduit 114 to obtain satisfactory operation. The two pump arrangement as shown in FIG. 5 is preferred for those installations in which the supply drum 102 is located at a distance that is too far from the press to achieve adequate suction flow. The auxiliary supply pump 110 provides positive flow input to the doctor blade reservoir at a fixed flow rate. The return suction pump 112 has a faster suction flow rate than the supply flow rate. Consequently, a positive pressure buildup in the doctor blade reservoir cannot occur. By utilizing two pumps as shown in FIG. 5, the liquid level within the doctor blade chamber 66 can be closely controlled, without positive pressure buildup, thereby reducing leakage through the end seals.

Figure 8:
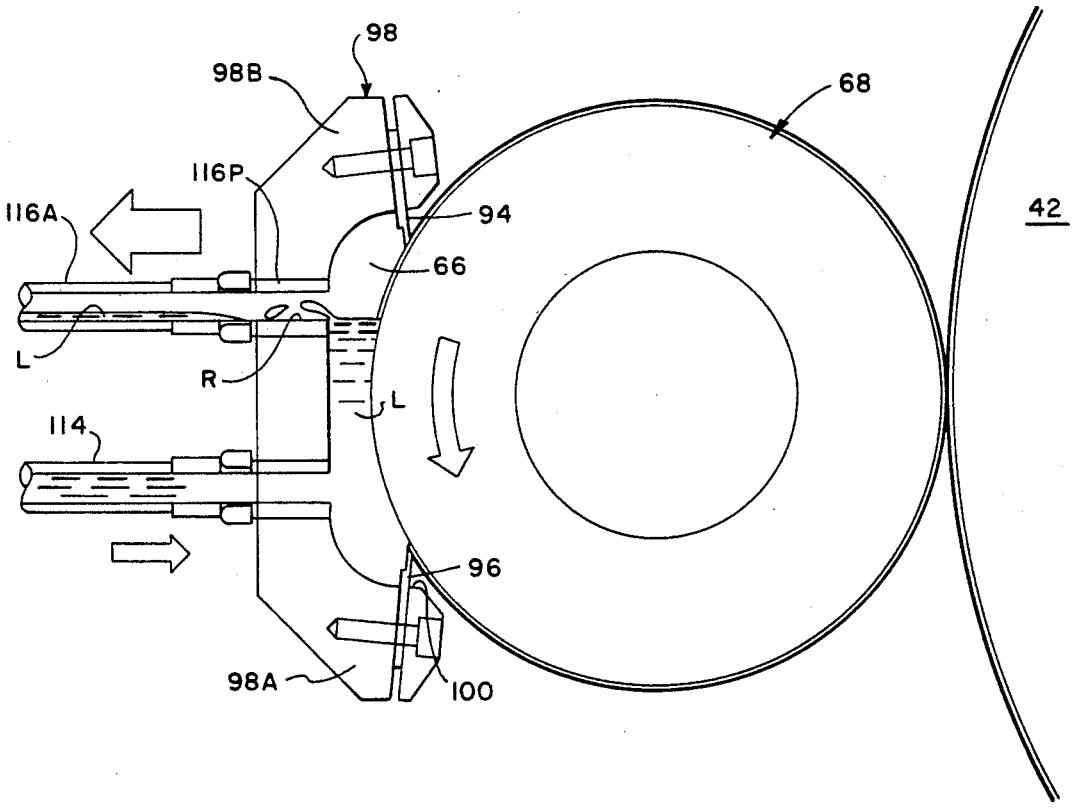
FIG. 8 is an enlarged sectional view taken substantially along the line 8—8 of FIG. 7; and, FIG. 9 is a view similar to FIG. 8 which includes a suction pressure sensing circuit for providing a visual indication of suction pressure and an audible alert when the suction/vacuum pressure inside the doctor blade rises above a safe operating level, thereby signaling an impending end seal failure.

Referring to FIG. 8, it will be appreciated that the doctor blade chamber 66 is maintained at a pressure level below atmospheric by the suction action of the return flow pump 112. The coating liquid L rises to the liquid level of the return port R and is drawn off immediately by the suction pump 112. Additionally, air within the doctor blade chamber 66 is also evacuated, thereby reducing the doctor blade chamber pressure to a level below atmospheric. This negative pressure differential condition opposes leakage of coating liquid L through the end seals. Since the doctor blade chamber 66 is not positively pressurized, the end seals are operated under favorable pressure differential conditions, thereby extending their useful lifetime. Moreover, the negative pressure differential doctor blade assembly will accommodate a pickup roller having a chipped corner, which would leak under positive pressure conditions, but does not leak because of the negative pressure reservoir condition established by suction flow.

Figure 9:
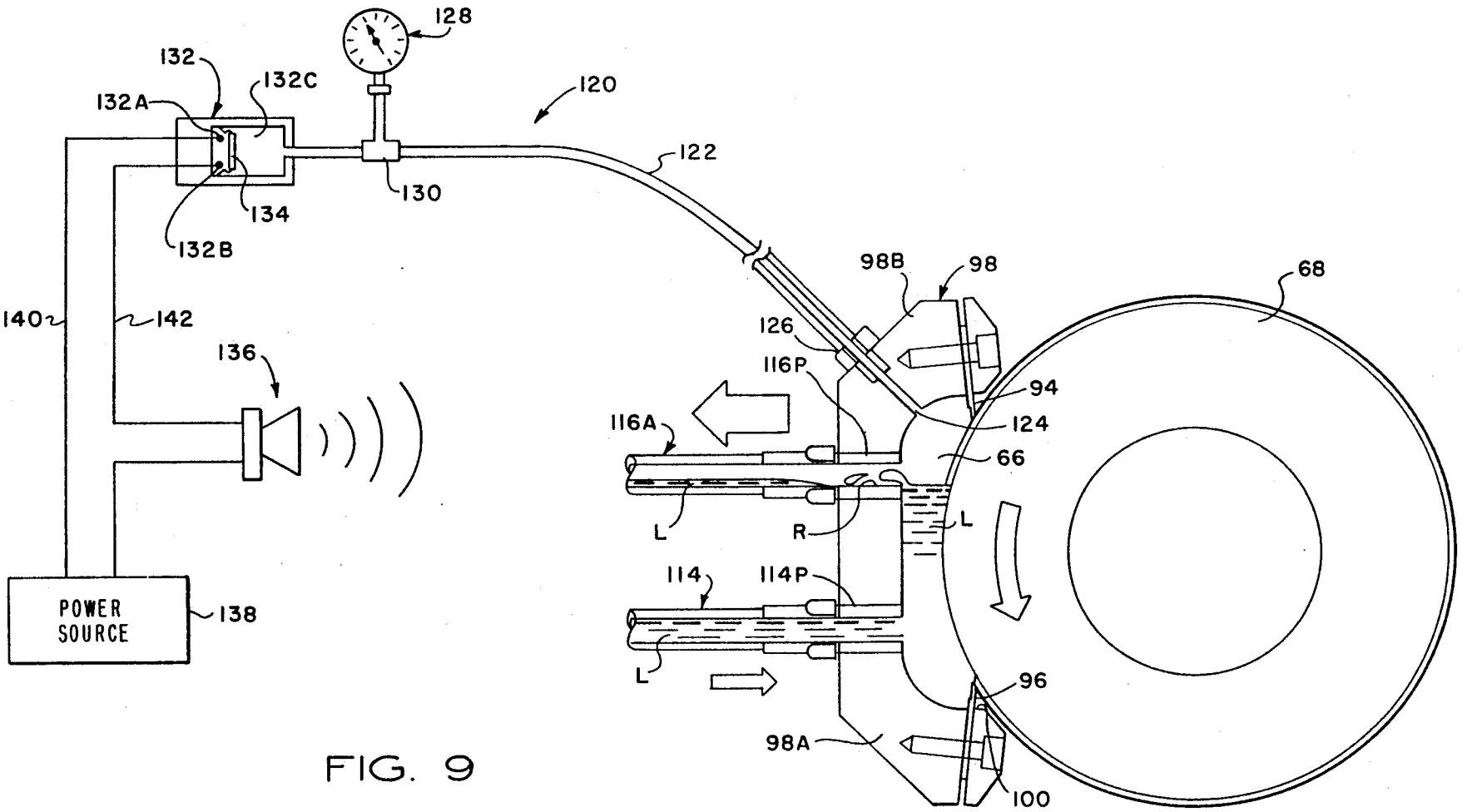

It is useful for the press operator to have an advance warning of an impending end seal failure. With advance warning, the press operator can schedule repair and/or replacement of the doctor blades and the end seals at a convenient time, for example between press runs or before undertaking the next printing job. Apparatus for monitoring the suction/vacuum condition within the doctor blade chamber 66 is provided by a pneumatic sensor circuit 120 as shown in FIG. 9. The pneumatic sensor circuit 120 includes a pneumatic sensor line 122 which is coupled in fluid communication with the doctor blade chamber 66 through a vacuum sensor bore 124 formed through the upper doctor head shoulder 98B. The vacuum sensor line 122 is coupled to the sensor bore 124 by a threaded fitting 126.

Continuous monitoring of the vacuum/suction condition within the doctor blade chamber 66 is provided by a vacuum gauge 128 which can be of any conventional design, for example a Bourdon gauge which is calibrated for dry air and covers the range from about zero to about twenty torrs. The vacuum gauge 128 is coupled into the sensor line 122 by a tee coupling 130. According to this arrangement, the press operator receives a continuous visual indication of the vacuum/suction condition within the doctor blade chamber 66.

According to another feature of the invention, the vacuum/suction line 122 is coupled to a vacuum switch 132. The vacuum switch 132 has a conductive, movable diaphragm 134 which moves into and out of electrical contact with switch electrodes 132A, 132B. That is, the diaphragm 134 is pulled out of contacting engagement with the switch electrodes 132A, 132B when the vacuum/suction level in the doctor blade chamber 66 is below a predetermined level. When the pressure level within the doctor blade chamber 66 rises above that preset level, for example in response to leakage of air through the end seals or around a worn doctor blade 94, the vacuum force within the vacuum chamber 132C of the sensor switch also rises, thereby permitting the conductive switch element 134 to engage the switch electrodes 132A, 132B.

When switch closure occurs, electrical power is applied to an audio transducer 136 from a power source 138. Electrical current is conducted through the pneumatic switch 132 to the audio transducer 136 through power conductors 140, 142. According to this arrangement, the press operator will receive an audible alert as soon as the suction/vacuum pressure in the doctor blade chamber rises above a safe operating level, thereby signaling wear failure of the doctor blades and/or an impending failure of the end seals.

From the foregoing, it should be apparent that the coating apparatus 10 of the present invention provides a highly reliable, effective and economical in-line apparatus for applying coating material to the freshly printed sheets 18 in a sheet-fed, offset rotary printing press 12 which allows the final printing station to continue to be used as a print station, yet which does not require any substantial press modification or the addition of a separate timed applicator roller. While a particular form of the present invention has been illustrated and described, it should be apparent that variations and modifications therein can be made without departing from the spirit and scope of the invention.

What is claimed is:

1. Apparatus for applying liquid material from a supply to a pickup roller comprising in combination:

a doctor blade head having an elongated reservoir for receiving liquid material from the supply, said doctor blade head being adapted to extend in parallel with the pickup roller in an operative position with a portion of the peripheral surface of the pickup roller extending into said reservoir for wetting contact with liquid material contained therein, and two doctor blades attached to said doctor blade head for engagement against said peripheral surface in the operative position;

a supply conduit connecting said supply in flow communication with said reservoir;

a return conduit connecting said reservoir in flow communication with said supply; and, a first pump coupled in series flow relation with said return conduit for inducing suction flow of liquid material from said reservoir through said return conduit into said supply.

2. Apparatus as defined in claim 1, including:

a second pump coupled in series flow relation with said supply conduit for pumping liquid material from said supply to said reservoir.

3. Apparatus as defined in claim 2, wherein the suction return pumping rate of said first pump is greater than the supply pumping rate of said second pump.

4. Apparatus as defined in claim 1, said doctor blade head having first and second shoulders forming lower and upper liquid level boundaries for said reservoir, respectively, wherein the return conduit is coupled in flow communication with said reservoir at a liquid level location disposed intermediate the liquid level boundaries established by said first and second shoulders.

5. Apparatus as defined in claim 1, wherein the return conduit is coupled in flow communication with said reservoir at a first liquid level location and the supply conduit is coupled in flow communication with said reservoir at a second liquid level location, the first liquid level location of the return conduit being higher in elevation than the second liquid level location of the supply conduit when the doctor blade head is in the operative position.

6. Apparatus for applying liquid material from a supply to a pickup roller comprising, in combination:

an elongated doctor blade head having an elongated cavity formed therein defining a reservoir for receiving liquid material from the supply, said doctor blade head being adapted to extend in parallel with the pickup roller in an operative position with a portion of the peripheral surface of the pickup roller extending into said cavity for wetting contact with liquid material contained therein, and a pair of doctor blades disposed on opposite sides of said cavity and extending the length thereof for engagement against the peripheral surface of the pickup roller in the operative position; and, means coupled to said supply and to said reservoir for inducing flow of liquid material from said supply into said reservoir and for returning excess liquid material by suction force from said reservoir to said supply.

7. Apparatus as defined in claim 6, said inducing means comprising:

a supply conduit connecting said supply in flow communication with said reservoir;

a return conduit connecting said reservoir in flow communication with said supply; and, a first pump coupled in series flow relation with said return conduit for inducing suction flow of liquid material from said supply through said supply conduit into said reservoir, and for inducing suction flow of liquid material from said reservoir through said return conduit into said supply.

8. Apparatus as defined in claim 7, said means including:

a second pump coupled in series flow relation with said supply conduit for pumping liquid material from said supply to said reservoir.

9. Apparatus as defined in claim 8, wherein the suction return pumping rate of said first pump is greater than the supply pumping rate of said second pump.

10. Apparatus as defined in claim 6, said doctor blade head having first and second shoulders forming lower and upper liquid level boundaries for said reservoir, respectively, wherein said means for inducing suction flow includes a return conduit coupled in flow communication with said reservoir at a liquid level location disposed intermediate the liquid level boundaries established by said first and second shoulders.

11. Apparatus for applying liquid material from a supply to a pickup roller comprising in combination:

a doctor blade head having an elongated reservoir for receiving liquid material from the supply, said doctor blade head being adapted to extend in parallel with the pickup roller in an operative position with a portion of the peripheral surface of the pickup roller extending into said reservoir for wetting contact with liquid material contained therein, and two doctor blades attached to said doctor blade head for engagement against said peripheral surface in the operative position;

first means coupled to said supply and to said reservoir for pumping liquid material from said supply into said reservoir; and, second means coupled to said reservoir and to said supply for inducing suction flow of liquid material from said reservoir into said supply.

12. Apparatus for applying liquid material from a supply to a pickup roller comprising in combination:

a doctor blade head having an elongated reservoir chamber for receiving liquid material from the supply, said doctor blade head being adapted to extend in parallel with the pickup roller in an operative position with a portion of the peripheral surface of the pickup roller extending into said reservoir chamber for wetting contact with liquid material contained therein, and two doctor blades attached to said doctor blade head for engagement against said peripheral surface in the operative position; and, a suction pump coupled to said reservoir and to said supply for inducing suction flow of liquid material from said reservoir to said supply.

13. Apparatus as defined in claim 12, including a pneumatic sensor conduit coupled to said reservoir chamber for sensing the air vacuum pressure within said reservoir chamber, and a vacuum gauge coupled to said sensor conduit for providing a visual indication of air vacuum pressure in said reservoir chamber.

14. Apparatus as defined in claim 12, including a pneumatic sensor conduit coupled to said reservoir chamber for sensing the air vacuum pressure within said reservoir chamber, a vacuum responsive switch having a sensing chamber coupled to said sensor conduit and switch electrodes and an audio transducer electrically connected to said switch electrodes for making and breaking an electrical circuit from a power source to said audio transducer.

15. In a sheet-fed, offset rotary printing press of the type including at least one printing station having a blanket cylinder and an impression cylinder disposed for printing ink onto sheets passing therebetween, and a delivery conveyor system for pulling freshly printed sheets from the impression cylinder and transporting the printed sheets toward a sheet delivery stacker, the delivery conveyor system including a delivery drive shaft disposed adjacent to and extending parallel with the impression cylinder and driven in timed synchronous relation with the impression cylinder, the improvement comprising:

a delivery cylinder mounted onto said delivery drive shaft and having an outer peripheral support surface adapted to engage and support a sheet being transported by said delivery conveyor system;

a coating apparatus including a supply of liquid material, a rotatable pickup roller having an outer peripheral surface of substantially cylindrical shape, and means for applying a coating of liquid material from said supply onto said outer peripheral surface of said pickup roller;

means for mounting said coating apparatus to the press adjacent said delivery cylinder with a portion of said peripheral surface of said pickup roller engaged with the support surface of said delivery cylinder, whereby liquid coating material from said supply applied onto the peripheral surface of said pickup roller is transferred to said support surface of said delivery cylinder and to said freshly printed sheet;

said coating apparatus including an elongated reservoir for receiving liquid material from said supply, said reservoir extending parallel with said pickup roller with a portion of the peripheral surface of the pickup roller extending into said reservoir for wetting contact with liquid material contained therein, and two doctor blades attached to said reservoir and engaging said peripheral surface, said doctor blades acting to limit the amount of liquid material applied onto said peripheral surface from said reservoir;

a supply conduit connecting said supply in flow communication with said reservoir;

a return conduit connecting said reservoir in flow communication with said supply; and, a first pump coupled in series flow relation with said return conduit for inducing suction flow return of liquid material from said reservoir to the remote supply.

16. The improvement as set forth in claim 15, wherein said coating apparatus is mounted to said press downstream of said delivery drive shaft in the direction of travel of said sheets during transport by said delivery conveyor system.

17. The improvement as set forth in claim 15, including:

a second pump coupled in series flow relation with said supply conduit for liquid material from the remote supply to said reservoir.

18. The improvement as set forth in claim 17, wherein the suction return flow rate of said first pump is greater than the positive pressure supply flow rate of said second pump.

19. The improvement as set forth in claim 15, wherein the return conduit is coupled in flow communication with said reservoir at a first liquid level location and the supply conduit is coupled in flow communication with said reservoir at a second liquid level location, the first liquid level location of the return conduit being higher than the second liquid level location of the supply conduit.

20. In a sheet-fed, offset rotary printing press of the type including at least one printing station having a blanket cylinder and an impression cylinder disposed for printing wet ink onto sheets passing therebetween, and a delivery conveyor system for pulling freshly printed sheets from the impression cylinder and transporting the printed sheets toward a sheet delivery stacker, the delivery conveyor system comprising a pair of endless gripper chains disposed on opposite sides of the press and supporting therebetween gripper bars and grippers spaced along the chains, the gripper chains being driven in timed synchronous relation with the impression cylinder by laterally spaced sprocket wheels mounted on opposite ends of a delivery drive shaft disposed adjacent to and extending parallel with the impression cylinder, the improvement comprising:

a delivery cylinder mounted to said delivery drive shaft between said sprocket wheels and having an outer peripheral support surface covered by a removable coating blanket adapted to engage and support the wet ink side of a sheet being transported by said gripper bars;

a coating apparatus including a supply of liquid material, a rotatable pickup roller having an outer peripheral surface of substantially cylindrical shape, and means for applying liquid material from said supply onto said peripheral surface of said pickup roller;

means for mounting said coating apparatus to the press adjacent the delivery cylinder, with a portion of the outer peripheral surface of said pickup roller engaged with said delivery cylinder, whereby liquid material doctored onto the peripheral surface of said pickup roller is transferred to said delivery cylinder and to said freshly printed sheet;

said coating apparatus including an elongated reservoir containing liquid material, said reservoir being disposed to extend parallel with said pickup roller with a portion of said peripheral surface extending into said reservoir in contact with liquid material contained therein, and two doctor blades attached to said reservoir and engaging said peripheral surface, said doctor blades acting to limit the amount of liquid coating material applied onto said peripheral surface from said reservoir;

a supply conduit connecting said supply in flow communication with said reservoir;

a return conduit connecting said reservoir in flow communication with said supply; and, a first pump coupled in series flow relation with said return conduit for inducing suction flow return of liquid material from said reservoir to said supply.

21. A sheet-fed, offset rotary printing press including:

at least one printing station having a blanket cylinder and an impression cylinder disposed for printing wet ink onto sheets passing therebetween;

a delivery conveyor system for pulling freshly printed sheets from the impression cylinder and transporting the printed sheets toward a sheet delivery stacker, the delivery system including a delivery drive shaft;

a delivery cylinder mounted to said delivery drive shaft and having an outer peripheral support surface adapted to engage and support a sheet being transported by said delivery conveyor system;

a coating apparatus including a supply of liquid material, a rotatable pickup roller having an outer peripheral surface of substantially cylindrical shape, and means for applying liquid material from said supply onto the peripheral surface of said pickup roller;

means for mounting said coating apparatus to the press adjacent said delivery cylinder, with a portion of said peripheral surface of said pickup roller engaged with said delivery cylinder, whereby liquid material applied to the peripheral surface of said pickup roller is transferred to said delivery cylinder and then to said freshly printed sheet;

said coating apparatus including an elongated reservoir containing liquid material, said reservoir being disposed to extend parallel with said pickup roller with a portion of said peripheral surface extending into the reservoir in contact with liquid material contained therein, and two doctor blades attached to said reservoir and engaging said peripheral surface, said doctor blades acting to limit the amount of liquid coating material applied onto said peripheral surface from said reservoir;

a supply conduit connecting said supply in flow communication with said reservoir;

a return conduit connecting said reservoir in flow communication with said supply; and, a first pump coupled in series flow relation with said return conduit for inducing suction flow return of liquid material from said reservoir to said supply.

* * * * *

UNITED STATES PATENT AND TRADEMARK OFFICE

CERTIFICATE OF CORRECTION

PATENT NO. : 5,207,159

DATED : May 4, 1993

INVENTOR(S) : Howard W. DeMoore and Steven M. Person

It is certified that error appears in the above-identified patent and that said Letters Patent is hereby corrected as shown below:

Column 3, line 48, "inline" should be -- in-line --;

Column 8, line 3, "preferably" should be -- Preferably --; and

Column 8, line 58, "16B" should be -- 116B --.

Signed and Sealed this

Fourth Day of January, 1994

*Attest:*

*Attesting Officer*

Bruce Lehman

BRUCE LEHMAN

*Commissioner of Patents and Trademarks*